United States Patent [19]

Brackett

[11] Patent Number: 4,912,797

[45] Date of Patent: Apr. 3, 1990

[54] PAINT BRUSH CLEANING DEVICE

[76] Inventor: Ted Brackett, 8330 Manchester Blvd., Apt. #5, Playa Del Rey, Calif. 90293

[21] Appl. No.: 228,139

[22] Filed: Aug. 4, 1988

[51] Int. Cl.[4] ..... A46B 17/06

[52] U.S. Cl. ..... 15/38; 15/21 C; 15/21 D; 15/21 E

[58] Field of Search ..... 15/21 E, 38, 39, 74, 15/77, 97 R, 21 C, 21 D

[56] References Cited

U.S. PATENT DOCUMENTS

| | | | |
|---|---|---|---|
| 1,542,025 | 6/1925 | Ballman | 15/38 |
| 2,036,840 | 4/1936 | Thiesen | 15/39 |
| 2,640,489 | 6/1953 | Boland | 15/38 |
| 3,080,591 | 3/1963 | Townsend | 15/38 |
| 3,348,253 | 10/1967 | McCoy | 15/38 |
| 4,018,240 | 4/1977 | Palthe | 15/38 |

*Primary Examiner*—Edward L. Roberts

*Attorney, Agent, or Firm*—John J. Posta, Jr.

[57] ABSTRACT

The paint brush cleaning device includes a housing with an open top and removable lid, a bottom drain and a mounting to hold paint brushes passing an opening in the lid down into the housing's central space which has brush cleaning liquid therein. A pair of rotatable cleaning rollers bracket the paint brushes in the central space. The rollers preferably are powered by an electric motor connected to the housing. A number of spaced upwardly directed jet nozzles are disposed in the central space for directing streams of cleaning liquid under pressure against the hard to clean heel areas of the paint brushes. An impeller pump may be connected to a manifold in the central space, from which manifold the jet nozzles extend. Two pairs of rollers may be used, with the members of each pair disposed vertically relative to each other and over which a continuous sheet may be trained. The sheet bears cleaning bristles and/or fingers. The device is simple, durable and efficient.

17 Claims, 3 Drawing Sheets

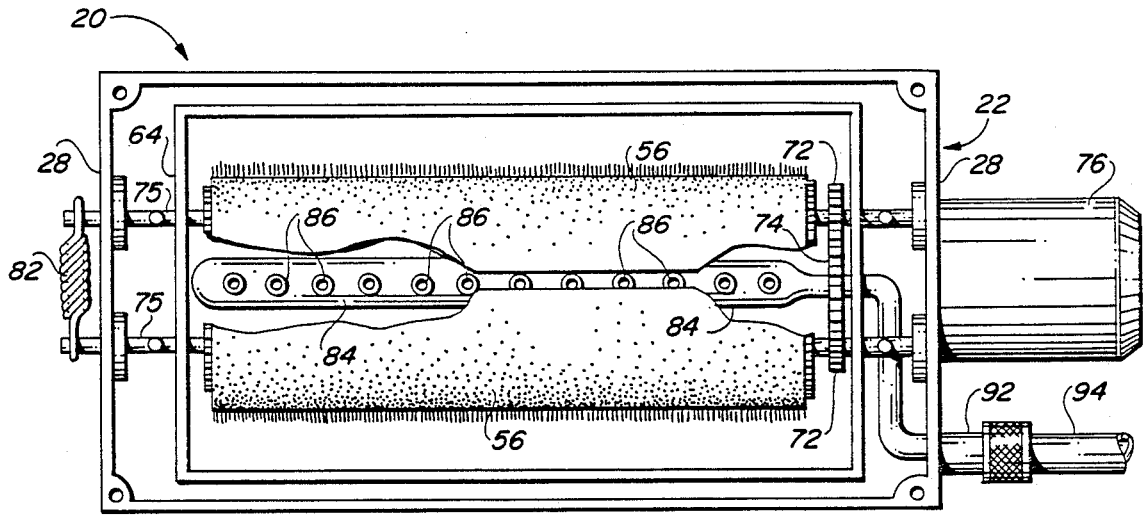
FIG. 3
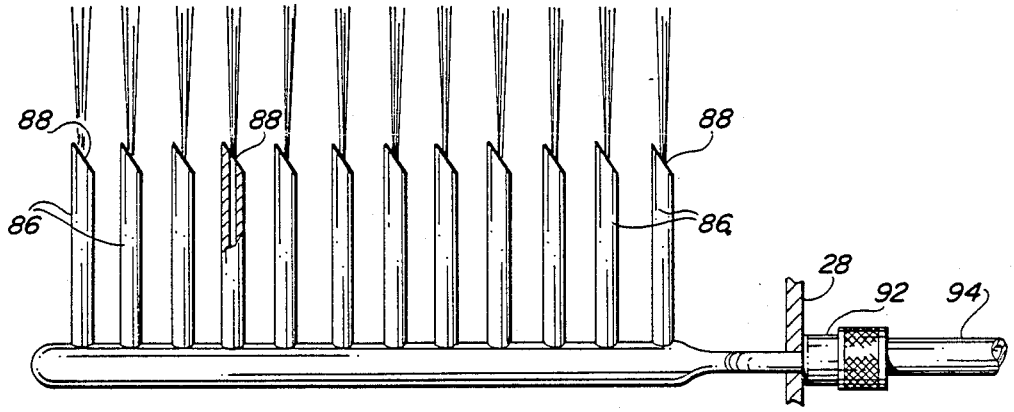
FIG. 4
FIG. 5
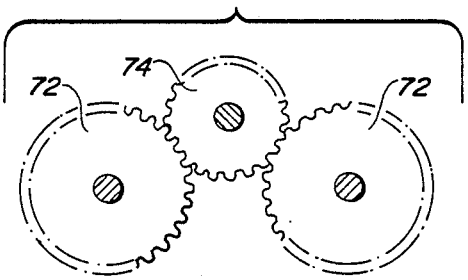
FIG. 6
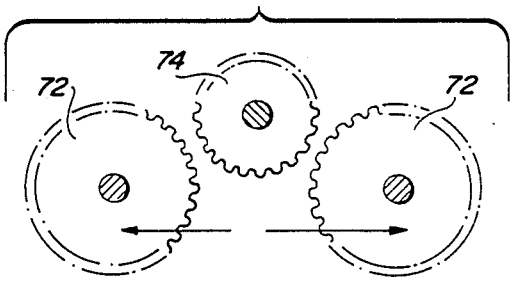
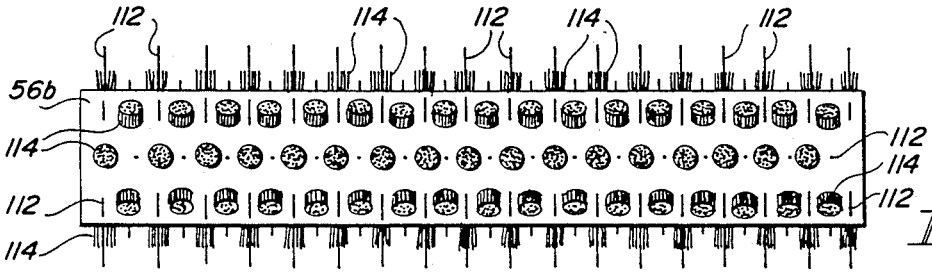
FIG. 8

PAINT BRUSH CLEANING DEVICE

BACKGROUND OF THE INVENTION

1. Field of the Invention

The present invention generally relates to cleaning means and, more particularly, to an improved paint brush cleaning device.

2. Prior Art

Various types of paint brush cleaning devices have been utilized in the past. See, for example, U.S. Pat. No. 1,542,025 which discloses a hand operated paint brush cleaner employing a pair of opposed bristle brushes in a pool of cleaning liquid. The cleaning brushes do not engage the paint brush heel; that is, where the bristles meet the handle and where much unwanted paint tends to accumulate. U.S. Pat. No. 2,737,945 discloses a device designed to dry hardened paint to powder through the use of heating elements, while U.S. Pat. No. 3,112,505 discloses a device which combs out softened paint lumps with a rotary pin comb. Other patents utilize the cleaning of such objects as golf club heads, hair combs, eyeglasses and hair brushes (see U.S. Pat. Nos. 3,872,534, 2,082,991, 3,464,080 and 3,590,413, respectively). None of such devices provide means useful in removing paint from paint brush heels.

There remains a need for a paint brush cleaning device which can easily and rapidly remove paint from the bristles of a paint brush, along the entire length of the bristles, including the heel portion of the brush. Such device should be simple, durable and efficient and be capable of being manufactured in a variety of forms to suit individual needs.

SUMMARY OF THE INVENTION

The improved paint brush cleaning device of the present invention satisfies all the foregoing needs. The device is substantially as set forth in the Abstract of the Disclosure. Thus, it comprises a housing with a flat bottom and upraised sidewalls defining a central space communicating with an open top bearing a removable lid. The lid has an opening in which one or a plurality of paint brushes can be releasably clamped so that the bristle portion of each paint brush hangs down into the central space for cleaning.

The central space holds a pair of rotatable cleaning rollers disposed on opposite sides of the opening so as to engage the sides of the paint brush. The rollers are driven by a motor connected to the housing and the rollers bear cleaning bristles and/or fingers on their outer surfaces. In an alternate embodiment, two pairs of rollers are used, the two members of each pair being vertically aligned in spaced relation, one pair on each side of the opening and each pair having a continuous sheet of cleaning material trained therearound. The material may be a flexible rubber or plastic sheet bearing cleaning bristles and/or fingers. In each instance the rollers do not bear bristles or fingers but are ridged to prevent slippage.

The housing also includes cleaning liquid, such as water or an organic liquid, such as petroleum distillate, a bottom drain, and a plurality of spaced vertically directed jet nozzles for injecting the cleaning liquid under pressure directly into the heel of each paint brush being cleaned. The nozzles may be in the form of long tubes or needles connected to a manifold, in turn connected to a pressurized source of cleaning liquid, such as a garden hose, or an impeller pump connected to the cleaning liquid in the central space.

The roller ends may be secured through a frame in the housing to tracks or slots in the housing wall so that they can be spring biased into engagement with opposite sides of the paint brushes and so that gear wheels on the rollers can engage drive gears connected to the motor.

Various other features of the present invention are set forth in the following detailed description and accompanying drawings.

DRAWINGS

FIG. 3 is a schematic top plan view of the device of FIG. 1 with the lid thereof removed;

FIG. 4 is a schematic side elevation of the manifold and jet nozzles of the device of FIG. 1;

FIG. 5 is a schematic front elevation of the drive gear and two roller gears of the device of FIG. 1, with the gears shown engaged for rotation of the rollers of FIG. 1;

FIG. 6 is a schematic front elevation of the gears of FIG. 5, shown with the gears in the disengaged position;

FIG. 8 is a schematic side elevation of a third preferred embodiment of the roller utilized in the device of the present invention;

DETAILED DESCRIPTION

FIGS. 1–6

Figure 1:
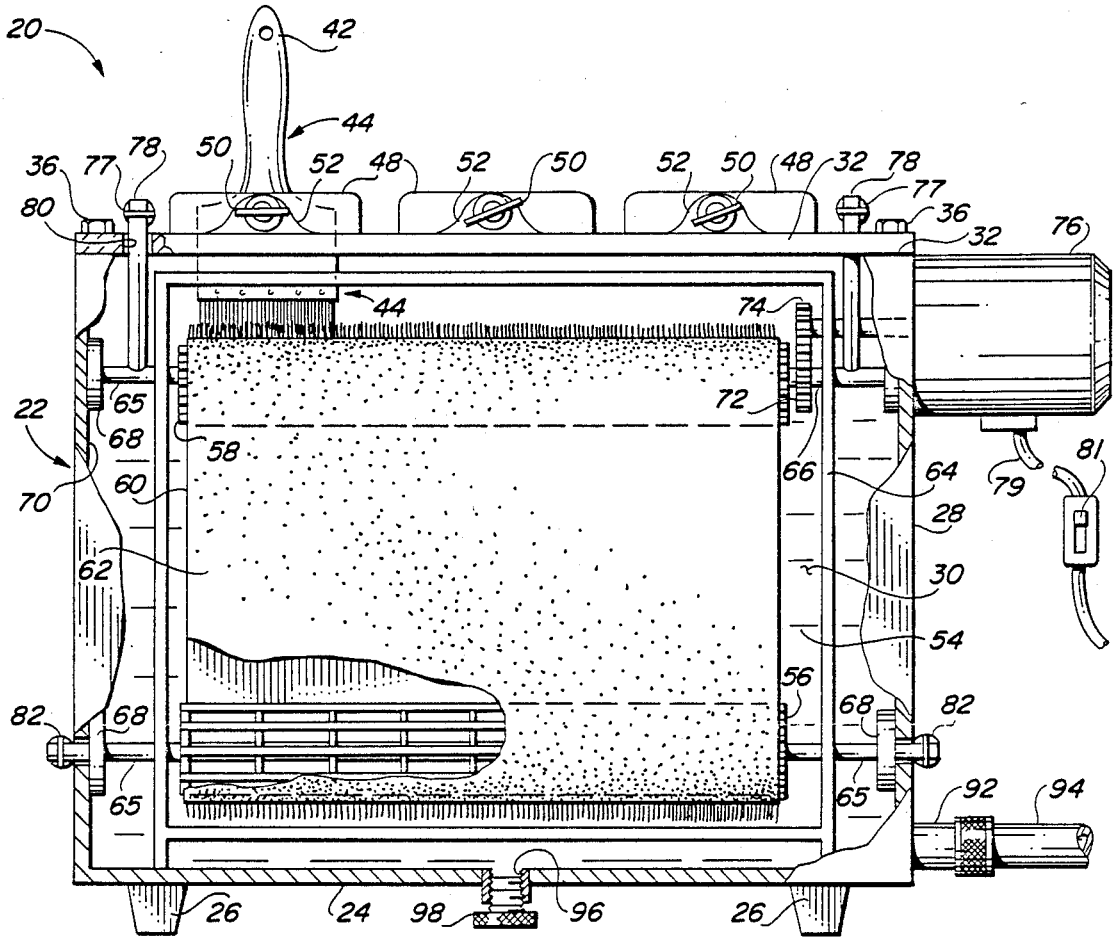
FIG. 1 is schematic side elevation, partly broken away, of a first preferred embodiment of the improved paint brush cleaning device of the present invention.
Figure 2:
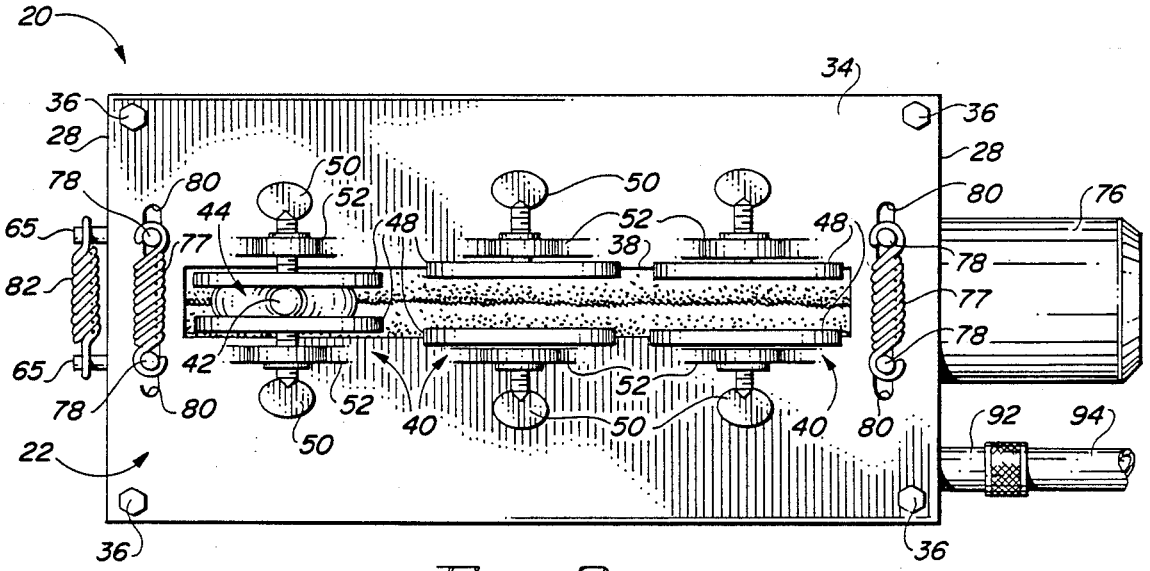
FIG. 2 is a schematic top plan view of the device of FIG. 1.

Now referring more particularly to FIGS. 1–6 of the drawings, a first preferred embodiment of the improved paint brush cleaning device of the present invention is schematically depicted therein. Thus, device 20 is shown, which comprises a housing or container 22 having a flat horizontal bottom 24 with depending legs 26 and upraised sidewalls generally designated 28 defining a central space 30 communicating with an open top 32 covered by a removable lid 34.

Lid 34 is connected to top 32 by a spaced pair of threaded bolts 36. Lid has an elongated control opening 38 communicating with central space 30 and bracketed by 3 substantially identical sets of clamps 40 designed to releasably hold the handles 42 of paint brushes such as brush 44 and allow the bristle portion 46 of each brush 44 to depend into space 30 and be cleaned. Each clamp 40 includes a pusher plate 48 fed into position by a screw 50 passing through a threaded arch 52.

Space 30 is partly filled with cleaning liquid 54 and contains two pairs of rollers 56 disposed on opposite sides of opening 38. The rollers 56 of each pair are vertically aligned and the outer surfaces 58 of rollers 56 are ribbed to prevent slippage of a continuous sheet 60 of flexible resilient cleaning material, such as plastic or rubber, trained around each pair of rollers 56. Since the members of each pair or rollers are spaced well apart verticially, the main length of each sheet 60 is vertical. Sheets 60 are designed to bracket the sides of bristle portion 46 of brush 44 and they bear a spaced plurality of cleaning bristles 62 adapted to comb and thoroughly clean bristle portion 46.

Rollers 56 are disposed in a frame 64 with non-rotating bars 65 at one end of upper rollers 56 and both ends of lower rollers 56 and with rotating spindles 66 at the opposite end of upper rollers 56. Bars 65 extend out of rollers 56 and into tracks 68 in the inner surface 70 of opposite sidewalls 28.

Bars 65 slip fit inside central openings (not shown) in rollers 56 while spindles 66 are fixedly secured to rollers 56.

A roller gear 72 is connected to a spindle 66 of the upper one of each pair of rollers 56 and is engageable with a drive gear 74 in turn connected to an electric motor 76 secured to the outside of housing 22, so as to effect rotation of rollers 56 and travel of sheets 60 thereafter. Motor 76 has a cord 79 bearing an off-on switch 81.

Gears 72 and 74 are shown in the engaged roller rotation position in FIG. 5 and in the disengaged roller idle position in FIG. 6. Gears 72 are urged into the engaged position by removable springs 77 spanning bars 78 extending up from upper bars 75 and through openings 80 in lid 34, by hand pressure and by removable springs 82 spanning lower bars 75 extending out through seals (not shown) in the lower ends of container 22.

When springs 77 and 82 are disconnected, bars 65 and 78 can be manually spread apart to disengage sheets 60 and brush portion 46 and also disengage gears 72 and 74. It will be understood that other equivalent spring biasing arrangements can be used in place of those described in order to urge pairs of rollers 56 toward each other to engage the sides of brush portion 46 and gears 72 with gear 74 to drive rollers 56.

It will be understood that, if desired, bars 65 can be identical to spindles 66; that is, rigidly connected to rollers 56, in which event bars 78 are slip fitted over bars 65. Moreover, bars 78 can be obviated and, instead, upper bars 65 can extend out through housing 22 and be connected to springs 77 in the manner of springs 82 with lower bars 65.

As can be seen in FIGS. 3 & 4, device 20 includes a manifold 84 in the lower end of space 30. Manifold 84 bears a plurality of spaced vertical elongated narrow diameter jet nozzles or tubes 86 having slant pointed upper ends 88. Tubes 86 are designed to deliver jets of cleaning liquid directly up into the upper heel portion 90 of paint brush 44, thoroughly freeing it of accumulated paint. Cleaning liquid is supplied directly to manifold 84 under pressure through an inlet 92 connected, in the case of when water is the cleaning liquid, to a garden hose 94 or other water conduit. The internal diameter of each jet tube 86 is smaller than that of the manifold so as to increase the relative jet spray force delivered therefrom.

Accordingly, manifold 84 and jet tubes 86 clean heel portion 90 of brush 44 rapidly and effectively while sheets 60 and bristles 62 clean the remainder of brush 44, just as rapidly and effectively. Three or more brushes 44 can be cleaned at the same time, even if of different sizes, springs 77 and 82 biasing sheets 60 thereagainst for a perfect fit. Excess and dirty cleaning liquid 54 can be drained from housing 22 through bottom drain 96 by removing screw plug 98. If desired, drain 96 can be connected by a hose (not shown) with a pump (not shown) which is also connected to hose 94, for recirculation of cleaning liquid 54 to housing 22. Device 20 can be fabricated of steel or other metal, plastic, and other materials and is inexpensive, durable and efficient.

FIG. 7

Figure 7:
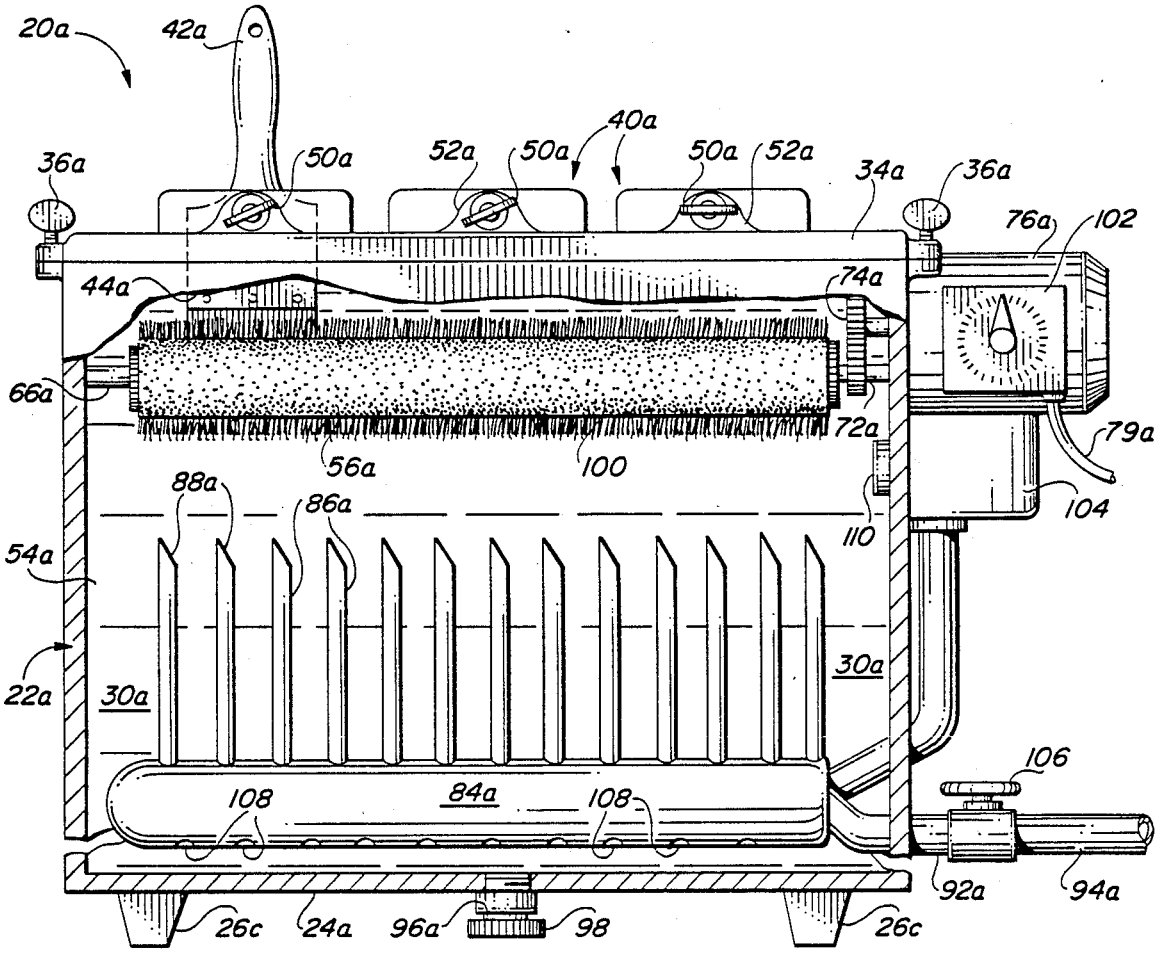
FIG. 7 is a schematic side elevation, partly broken away, of a second preferred embodiment of the improved paint brush cleaning device of the present invention.

A second preferred embodiment of the improved paint brush cleaning device of the present invention is schematically depicted in FIG. 7. Thus, device **20*a*. Components similar to those of device 20** bear the same numerals but are succeeded by the letter "a".

Device **20*a* is substantially identical to device 20**, except as follows:

(a) only two rotatable rollers **56*a* are used and no sheets such as sheets 60. Rollers 56*a* themselves bear cleaning bristles 100**;

(b) rollers **56*a* are disposed in fixed lateral positions in housing 22*a* (without the use of a frame) on opposite sides of paint brush 44*a* by spindles 66*a* on both ends connected to housing 22 because of the length of bristles 100 and spongy-like exterior of rollers 56*a*, rollers 56*a* are able to accommodate brushes 44** of various widths;

(c) motor **76*a* has a rheostat 102 and also powers an impeller pump 104 or the like connected to it and to manifold 84*a* bearing jet tubes 86*a*; manifold 84*a* is also connected to inlet 92*a* and hose 94*a* but there is a cut-off valve 106 in inlet 92*a*. Manifold 84*a* may have, if desired, openable bottom inlet holes 108, and pump 104 has an inlet 110 from space 30*a***.

In most respects, device **20*a* functions similarly to and has the advantages of device 20**, but is simpler to make.

FIGS. 8–11

Figure 9:
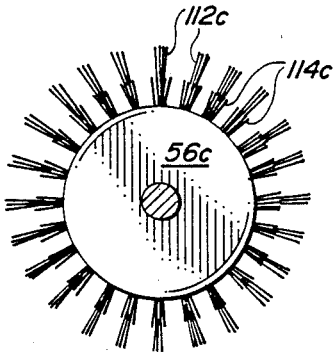
FIG. 9 is a schematic end view of a fourth preferred embodiment of the roller utilized in the device of the present invention; and, FIGS. 10 and 11 are schematic end views of, respectively, a fifth and a sixth preferred embodiment of the roller utilized in the device of the present invention.
Figure 10:
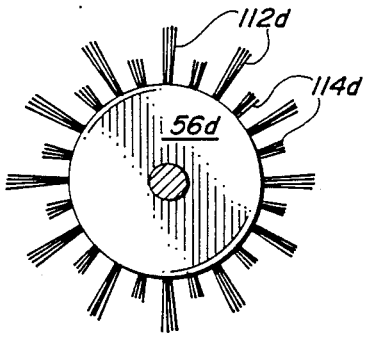
Figure 11:
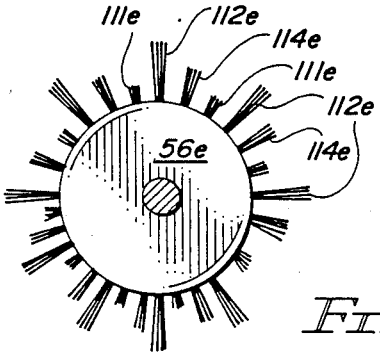

FIGS. 8–11 illustrate alternate embodiments of bristle and finger configurations for rollers **56*a* of device 20*a* of FIG. 7. These configurations can also be adapted for use in sheets 60 of device 20 of FIGS. 1–6. In FIG. 8, roller 56*b* is shown in schematic side elevation utilizing a pattern of alternating longitudinal rows of long slender flexible single fingers 112 and short clumps of bristles 114. In FIG. 9, roller 56*c* is shown in schematic end view bearing a pattern in which individual short clumps of bristles 114*c* alternate in the same longitudinal rows with individual long fingers 112*c*. In FIG. 10, longitudinal rows of short fingers 112*d* alternate with longitudinal rows of longer bristles 114*d*, while in FIG. 11, longitudinal rows of long fingers 112*e* alternate with longitudinal rows of short bristles 114*e*$^{I}$ and with longitudinal rows of longer bristles 114*e*$^{II}$**.

For best cleaning results it has been found preferable to employ patterns which alternate fingers 112 with clamps of bristles 114 such as are illustrated in FIGS. 8–11.

Various other modifications, changes, alterations and additions can be made in the improved cleaning device of the present invention, its components and parameters. All such modifications, changes, alterations and additions as are within the scope of the appended claims form part of the present invention.

What is claimed is:

1. An improved paint brush cleaning device, said device comprising, in combination:

(a) a housing having closed sides and bottom defining a central space containing paint brush cleaning liquid and an open top accessible to said space and covered by a removable lid; said lid having an opening communicating with said space;

(b) mounting means for removably mounting paint brushes in said opening so as to depend into said space for cleaning by said cleaning liquid;

(c) paint brush cleaning roller means rotatably mounted on opposite sides of said opening in said space for engagement of opposite sides of said paint brushes to contact said paint brushes;

(d) electrical motor means connected to said housing for rotating said rollers to clean said paint brushes;

(e) a plurality of spaced upwardly directed jet nozzles disposed in said central space below said brushes for cleaning the heels of said paint brushes; and, (f) means for forcefully impelling a stream of said cleaning fluid through each of said nozzles vertically towards said heel so that said stream of fluid and roller means simultaneously act upon the paint brushes to effect cleaning thereof.

2. The improved paint brush cleaning device of claim 1 wherein said jet nozzles are connected to a manifold in said central space and wherein said mounting means includes a plurality of clamps mounted on said lid to releasably hold said paint brushes.

3. The improved paint brush cleaning device of claim 2 wherein said roller means bear gears connected to a drive gear powered by said motor means connected to said housing.

4. The improved paint brush cleaning device of claim 3 wherein said roller means are spring biased into engagement with the sides of said paint brushes and wherein said gears are spring biased into engagement with said drive gear for rotation of said rollers.

5. The improved paint brush cleaning device of claim 4 wherein a frame is disposed within said housing central space, in which housing said roller means are suspended, through which frame extend roller pins which slide in tracks on the inside of said housing for said engagement and disengagement of said roller means and gears.

6. The improved paint brush cleaning device of claim 1 wherein said roller means comprise two pairs of said rollers, the rollers of each pair being spaced vertically from each other in said central space and around which a continuous flexible resilient sheet of paint brush cleaning material is trained.

7. The improved paint brush cleaning device of claim 6 wherein said sheet bears a plurality of at least one of cleaning bristles and cleaning fingers on the outer surface thereof and wherein said rollers have a non-skid outer surface to prevent slippage between said sheet and rollers in each pair.

8. The improved paint brush cleaning device of claim 7 wherein the lower rollers of each pair are spring biased toward each other, upper rollers of said pairs are biased toward each other.

9. The improved paint brush cleaning device of claim 1 wherein said device includes a rheostat to control said motor.

10. An improved paint brush cleaning device, said device comprising, in combination:

(a) a housing having closed sides and bottom defining a central space containing paint brush cleaning liquid and an open top accessible to said space and covered by a removable lid; said lid having an opening communicating with said space;

(b) means for removably mounting paint brushes in said opening so as to depend into said space for cleaning by said cleaning liquid;

(c) a pair of paint brush cleaning rollers rotatably mounted on opposite sides of said opening in said space for engagement of opposite sides of said paint brushes to contact said paint brushes;

(d) power means connected to said housing for rotating said rollers to clean said paint brushes;

(e) a plurality of spaced upwardly directed jet nozzles disposed in said central space for cleaning the heels of said paint brushes; and, (f) means for impelling a stream of said cleaning fluid through each of said nozzles for said heel cleaning, (g) wherein said rollers bear a pattern of alternating bristles and fingers on the outer surface thereof to effect scraping and cleaning of a paint brush when in contact therewith.

11. An improved paint brush cleaning device, said device comprising, in combination:

(a) a housing having closed sides and bottom defining a central space containing paint brush cleaning liquid and an open top accessible to said space and covered by a removable lid; said lid having an opening communicating with said space;

(b) means for removably mounting paint brushes in said opening so as to depend into said space for cleaning by said cleaning liquid;

(c) a pair of paint brush cleaning rollers rotatably mounted on opposite sides of said opening in said space for engagement of opposite sides of said paint brushes to contact said paint brushes;

(d) power means connected to said housing for rotating said rollers to clean said paint brushes;

(e) a plurality of spaced upwardly directed jet nozzles disposed in said central space for cleaning the heels of said paint brushes; and, (f) means for impelling a stream of said cleaning fluid through each of said nozzles for said heel cleaning, (g) wherein said power means includes an electric motor to power said rollers, and a rheostat to control said motor, and (h) an impeller pump and a manifold bearing said jet nozzles, (i) wherein said motor powers the impeller pump which is connected to the manifold to circulate cleaning fluid from the housing through the nozzles.

12. An improved paint brush cleaning device comprising:

(a) mounting means for holding at least one paint brush in a relatively fixed position, (b) rotary brush cleaning means connected to said mounting means, and so positioned as to be operatively associated with said brush, (c) fluid brush cleaning means also connected to said mounting means and so positioned as to be operatively associated with said brush, (d) a housing serving to interconnect said mounting means, rotary brush cleaning means, and said fluid brush cleaning means, (e) said housing has closed sides and bottom defining a central space adapted to contain paint brush cleaning liquid and an open top accessible to said space, and covered by a lid, (f) said mounting means being disposed over and communicating with said space, whereby said brush depends into said space, (g) said rotary brush cleaning means, including a pair of brush cleaning rollers rotatably mounted opposite one another and adapted to receive therebetween said paint brush to effect cleaning thereof, (h) said rotary brush cleaning means further including power means connected to said housing for rotating said rollers to clean said paint brush, (i) said fluid brush cleaning means including at least one jet nozzle, (j) said fluid brush cleaning means further including means for impelling a stream of cleaning fluid through said nozzle for cleaning said brush, (k) wherein said mounting means are adapted to releasably retain a plurality of brushes, and (l) wherein said fluid brush cleaning means includes a plurality of nozzles, and (m) wherein there are two pairs of said rollers, the rollers of each pair being spaced vertically from each other in said central space and around which a continuous flexible resilient sheet of paint brush cleaning material is trained.

13. The improved paint brush cleaning device of claim 12 wherein said sheet bears a plurality of at least one of cleaning bristles and cleaning fingers on the outer surface thereof and wherein said rollers have a non-skid outer surface to prevent slippage between said sheet and rollers in each pair.

14. The improved paint brush cleaning device of claim 13 wherein said lower rollers are spring biased toward each other, as are said upper rollers biased toward each other.

15. The improved paint brush cleaning device of claim 12 wherein said rollers bear a pattern of alternating bristles and fingers on the outer surface thereof to effect scraping and cleaning of a paint brush when in contact therewith.

16. The improved paint brush cleaning device of claim 12 wherein said power means includes an electric motor to power said rollers, and a rheostat to control said motor.

17. An improved paint brush cleaning device comprising:

(a) mounting means for holding at least one paint brush in a relatively fixed position, (b) rotary brush cleaning means connected to said mounting means, and so positioned as to be operatively associated with said brush, (c) fluid brush cleaning means also connected to said mounting means and so positioned as to be operatively associated with said brush, (d) a housing serving to interconnect said mounting means, rotary brush cleaning means, and said fluid brush cleaning means, (e) said housing has closed sides and bottom defining a central space adapted to contain paint brush cleaning liquid and an open top accessible to said space, and covered by a lid, (f) said mounting means being disposed over and communicating with said space, whereby said brush depends into said space, (g) said rotary brush cleaning means, including a pair of brush cleaning rollers rotatably mounted opposite one another and adapted to receive therebetween said paint brush to effect cleaning thereof, (h) said rotary brush cleaning means further including power means connected to said housing for rotating said rollers to clean said paint brush, (i) said fluid brush cleaning means including at least one jet nozzle, (j) said fluid brush cleaning means further including impeller means for impelling a stream of cleaning fluid through said nozzle for cleaning said brush, said impeller means comprising a pump, (k) wherein said mounting means are adapted to releasably retain a plurality of brushes, and (l) wherein said fluid brush cleaning means includes a plurality of nozzles, and (m) wherein said power means includes an electric motor to power said rollers, and a rheostat to control said motor, and (n) wherein said motor powers the impeller means pump which is connected to a manifold to circulate cleaning fluid from the housing through the nozzle.

* * * * *